US008508462B2

(12) United States Patent
Yoo et al.

(10) Patent No.: US 8,508,462 B2
(45) Date of Patent: Aug. 13, 2013

(54) DIMMING STRUCTURE FOR IMAGE DISPLAY DEVICE

(75) Inventors: Chul Hee Yoo, Gyunggi-Do (KR); Ho Sik Ahn, Incheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 971 days.

(21) Appl. No.: 11/647,403

(22) Filed: Dec. 29, 2006

(65) Prior Publication Data

US 2007/0159449 A1 Jul. 12, 2007

(30) Foreign Application Priority Data

Jan. 9, 2006 (KR) ..... 10-2006-0002244

(51) Int. Cl.
*G09G 3/36* (2006.01)

(52) U.S. Cl.
USPC ..... 345/102; 349/61; 362/97.1

(58) Field of Classification Search
USPC ..... 345/102; 349/64, 61–63, 65–71; 362/97.1–97.4
See application file for complete search history.

(56) References Cited

U.S. PATENT DOCUMENTS

| | | | |
|---|---|---|---|
| 4,907,862 | A | 3/1990 | Suntola |
| 5,220,442 | A | 6/1993 | Dingwall et al. |
| 2005/0036082 | A1 | 2/2005 | Lai |

FOREIGN PATENT DOCUMENTS

| | | | |
|---|---|---|---|
| DE | 36 06 404 | A1 | 9/1986 |
| EP | 1 564 479 | A1 | 8/2005 |
| GB | 2 242 052 | A | 9/1991 |
| JP | 05-127144 | | 5/1993 |
| JP | 2000-233136 | | 8/2000 |
| JP | 2001-272652 | | 10/2001 |
| JP | 2001-318615 | | 11/2001 |
| TW | 200506452 | | 2/2005 |

OTHER PUBLICATIONS

Machine translation of JP 05-0127144.*
German Office Action, w/ English translation thereof, issued in German Patent Application No. 10 2006 062 021.6-55 dated May 20, 2009.
Dutch Search Report issued in Dutch Patent Application No. NL 2000412, mailed Feb. 19, 2008.
Japanese Office Action, with English Translation, issued in Japanese Patent Application No. 2006-353160, dated Feb. 2, 2010.
Taiwanese Examination Report, w/ English translation thereof, issued in Taiwanese Patent Application No. TW 095149157 dated Jul. 1, 2011.

* cited by examiner

*Primary Examiner* — Michael Pervan
(74) *Attorney, Agent, or Firm* — McDermott Will & Emery LLP

(57) ABSTRACT

A dimming structure for an image display device further includes a contrast panel for altering contrast differences in a portion around an outputted image to achieve dimming effects on an image smaller than a light emitting lamp. In the dimming structure, a backlight unit has a plurality of light sources disposed therein. A display panel displays an image while the backlight unit is disposed to light the display panel. A contrast panel is disposed between the backlight unit and the display panel. The contrast panel has a light emitting window formed in a portion thereof corresponding to the image of the display panel to transmit light emitted from the backlight unit therethrough. The dimming structure assures uniform dimming effects on the portion around the image despite use of a light source bigger than the image to be outputted.

5 Claims, 5 Drawing Sheets

DIMMING STRUCTURE FOR IMAGE DISPLAY DEVICE

CLAIM OF PRIORITY

This application claims the benefit of Korean Patent Application No. 2006-02244 filed on Jan. 9, 2006 in the Korean Intellectual Property Office, the disclosure of which is incorporated herein by reference.

BACKGROUND OF THE INVENTION

1. Field of the Invention

The present invention relates to a dimming structure for an image display device in which light and darkness around an image outputted through the display device is controlled to impart vividness to the image, and more particularly, a dimming structure for an image display device which further includes a contrast panel for altering contrast differences in a portion around the image outputted in order to produce dimming effects on the image smaller than a light emitting lamp.

2. Description of the Related Art

With various display devices popularized and commercialized, there has been considerable technological advancement in color reproducibility and power consumption reduction. Lately, a liquid crystal display (LCD) has been noticeably adopted for the display devices.

In general, the LCD device is constructed of a display panel for displaying an image through light and a backlight unit for generating light. The backlight unit is designed mainly to supply light evenly to an effective display area where the image of the display panel is displayed.

Recently, in an effort to develop the LCD device, diverse approaches have been deployed to output a more vivid and life-like image, i.e., an image with visual depth to enhance display quality. To impart vividness and visual depth to the image, chiefly, brightness has been partially boosted to increase a contrast ratio. Moreover, the LCD devices featuring this function have been put on the market.

A conventional LCD device will be explained in detail hereunder with reference to the accompanying drawings.

FIG. 1 sequentially illustrates operation of the conventional LCD device.

As shown in FIG. 1, the conventional LCD device 1 includes a backlight unit 2 provided with a plurality of light sources 20 and a display panel 3 for displaying an image 30. Here, each of the light sources 20 is shaped as a bar.

According to an example shown in FIG. 1, as an image such as light moves in a dark place, a peripheral portion of the image 30 also is moderately brightened. When the image 30 is displayed in a portion of the display panel 3 as in step (a), one of the light sources corresponding to the image 30, i.e., a third light source is a high brightness light source 22. Also, left and right ones of the light sources 20 about the high brightness light source 22, i.e., the second and fourth light sources are low brightness light sources 24. The rest of the light sources excluding the high-brightness and low-brightness light sources 22 and 24 are off light sources 26 that do not emit light.

In step (b) where the image 30 is shifted to the right by a half width of the light source 20 from step (a), a third light source and the fourth light source between which the image 30 is straddled are the high-brightness light source 22. Moreover, left and right ones of the light sources 20 about the high-brightness light source 22, i.e., the second light source and a fifth light source are the low-brightness light sources 24. The rest of the light sources excluding the high-brightness and low-brightness light sources 22 and 24 are the off light sources 26 that do not emit light.

Further, in step (c) where the image 30 is shifted to the right by a half width of the light source 20 from step (b), the image 30 corresponds to only the fourth light source. Thus, the fourth light source is the high-brightness light source 22 and left and right ones of the light sources 20 about the high-brightness light source 22, i.e., the third and fifth light sources are the low-brightness light sources 24. The rest of the light sources excluding the high-brightness and low-brightness light sources 22 and 24 are the off light sources 26 that do not emit light.

In this fashion, each of the light sources 20 is varied in light emitting amount according to location of the image 30 to enhance life-likeness of the image 30. That is, the image 30 is displayed bright, the peripheral portion thereof is displayed moderately bright, i.e., dim, and a portion located at a predetermined distance from the image is displayed dark.

Here, in a case where the light source 20 has a width very smaller than that of the image 30, the dim portion is displayed more clearly, thus more assuring life-likeness. Meanwhile, in a case where the light source has a width similar to or greater than that of the image 30, the dim portion is not displayed clearly, thus rendered less life-like. That is, in a case where the image 30 is positioned to correspond to only one of the light sources 20 as in step (a), left and right portions from the image 30 correspond to only the low-brightness light sources 24, thus making the left and right portions from the image 30 evenly bright. On the other hand, in a case where the image 30 straddles between the two light sources 20 as in step (b), the left and right portions from the image 30 correspond to the high-brightness light source 22 and the low-brightness light source 24, respectively. This leads to differences in brightness between the left and right portions from the image 30, thereby undermining vividness.

In addition, as shown in FIG. 1, when the light sources 20 are respectively shaped as a bar, some portions of the panel 3 positioned above and under the image 30 correspond to the area of the high-brightness light source 22, thus looking brighter than other portions of the panel 3 positioned in the left and right from the image 30.

FIG. 2 sequentially illustrates operation of another conventional LCD device.

To solve the problem of the LCD device shown in FIG. 1, the LCD device 1 has been suggested, in which a plurality of small LEDs 10 are densely arranged thereon as shown in FIG. 2.

When the LCD device 10 of FIG. 2 displays an image such as bright light, some portions of the LEDs corresponding to the image are a high-brightness LED 12. Some other LEDs arranged adjacent to the high-brightness LED 12 are a low-brightness LED 14 and the rest of the LEDs are an off LED 16, thereby giving visual depth to the image.

As described above, the LCD device 1 having the small LEDs arranged thereon more densely can display a smaller image by operating the LEDs positioned in the left and right sides and the upper and lower sides individually. Accordingly, the LCD device 1 can more clearly display a peripheral portion of the image, i.e., where light is emitted dimly, thereby leading to a more life-like image.

However, the conventional LCD device shown in FIG. 2 requires a plurality of LEDs to be disposed thereon, thus increasing manufacturing costs and consuming great power. Also, each of the LEDs releases considerable heat amount, thus necessitating a separate heat releasing structure. Moreover, in the conventional LCD device, each of the LEDs should be respectively wired to be controlled independently.

This complicates internal configuration of the device and requires a significant number of circuit structures.

SUMMARY OF THE INVENTION

The present invention has been made to solve the foregoing problems of the prior art and therefore an aspect of the present invention is to provide a dimming structure for an image display device which can cause uniform dimming effects on a portion around an image, simplifies internal configuration thereof and solve consumption power and heat releasing problems despite use of a light source bigger than an image tobe inputted.

According to an aspect of the invention, the invention provides a dimming structure for an image display device including a backlight unit having a plurality of light sources disposed therein; a display panel for displaying an image, the backlight unit disposed to light the display panel; and a contrast panel disposed between the backlight unit and the display panel, the contrast panel having alight emitting window formed in a portion thereof corresponding to the image of the display panel to transmit light emitted from the backlight unit therethrough.

The light emitting window is center-aligned with the image outputted from the display panel.

Preferably, the light emitting window has a size smaller than the image outputted from the display panel.

The light emitting window has a horizontal cross-section variable in shape in accordance with a shape of the image.

The contrast panel is configured to transmit the light from the backlight unit through the light emitting window excluding the rest of the backlight unit.

The backlight unit is configured such that one of the light sources corresponding to the image of the display panel emits brighter light, an adjacent one of the light sources emits less bright light and the rest of the light sources do not emit light.

The light sources are arranged in parallel and, respectively, in a bar shape.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 3:
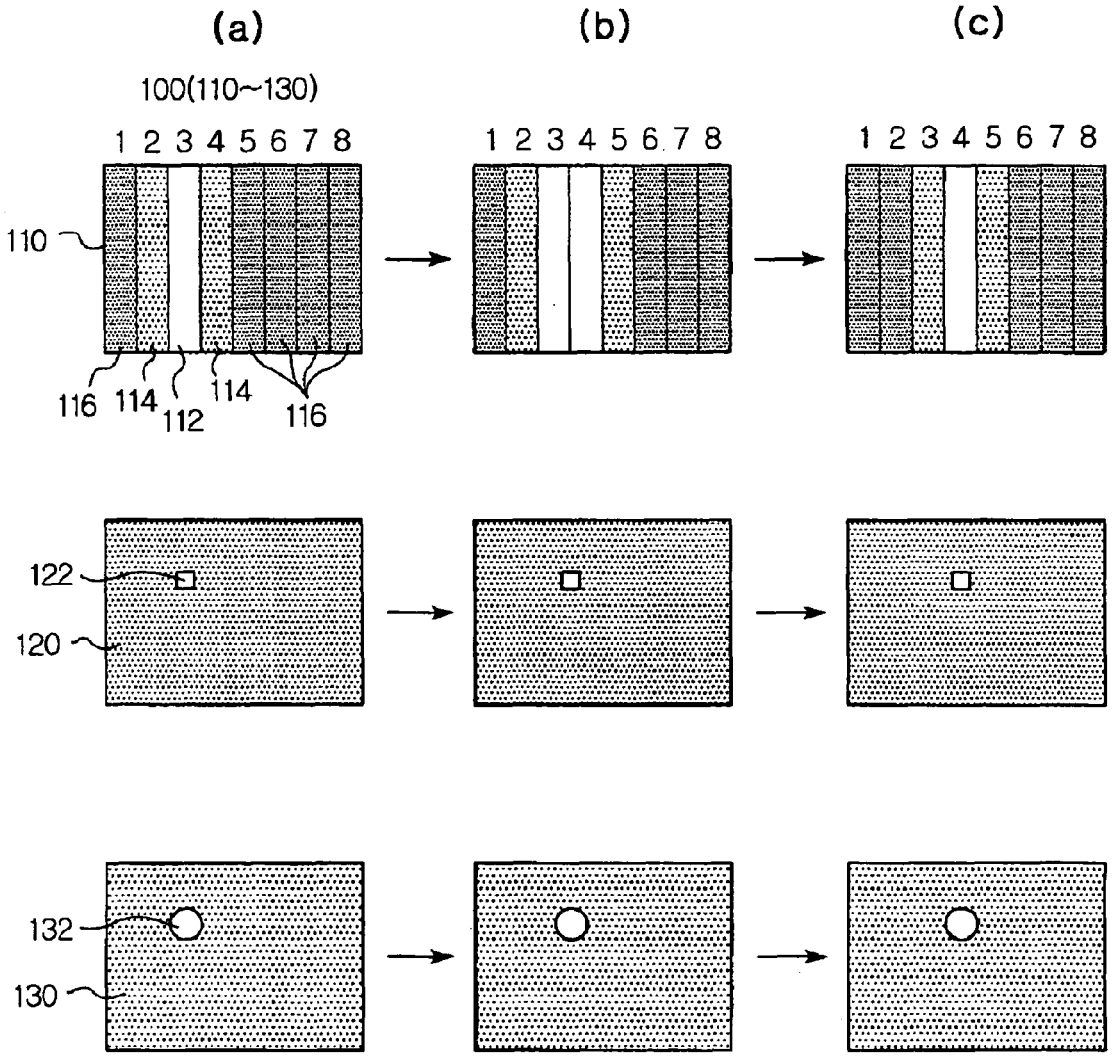
FIG. 3 sequentially illustrates operation of each component included in a dimming structure according to the invention.
Figure 4:
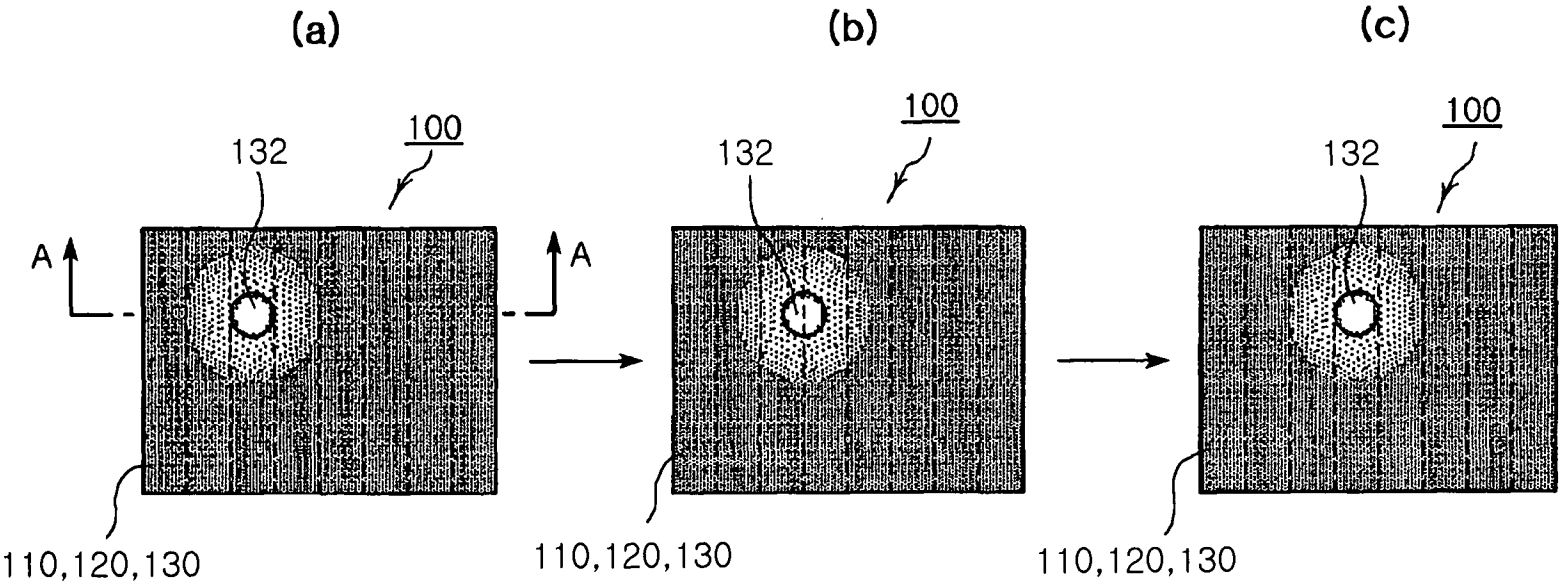
FIG. 4 is a top view sequentially illustrating operation of a dimming structure according to the invention.

FIG. 3 sequentially illustrates operation of each component included in a dimming structure according to the invention. FIG. 4 is a top view sequentially illustrating operation of a dimming structure according to the invention.

As shown in FIGS. 3 and 4, the dimming structure 100 of the invention includes a backlight unit 110, a display panel 130 and a contrast panel 120. The backlight unit 110 has a plurality of light sources disposed therein. The display panel 130 displays an image 132 when the backlight unit 110 is disposed to light the display panel 130. The contrast panel 120 is disposed between the backlight unit 110 and the display panel 130. The contrast panel 120 has a light emitting window formed in a portion thereof corresponding to the image of the display panel to transmit light emitted from the backlight unit 110 therethrough.

Figure 1:
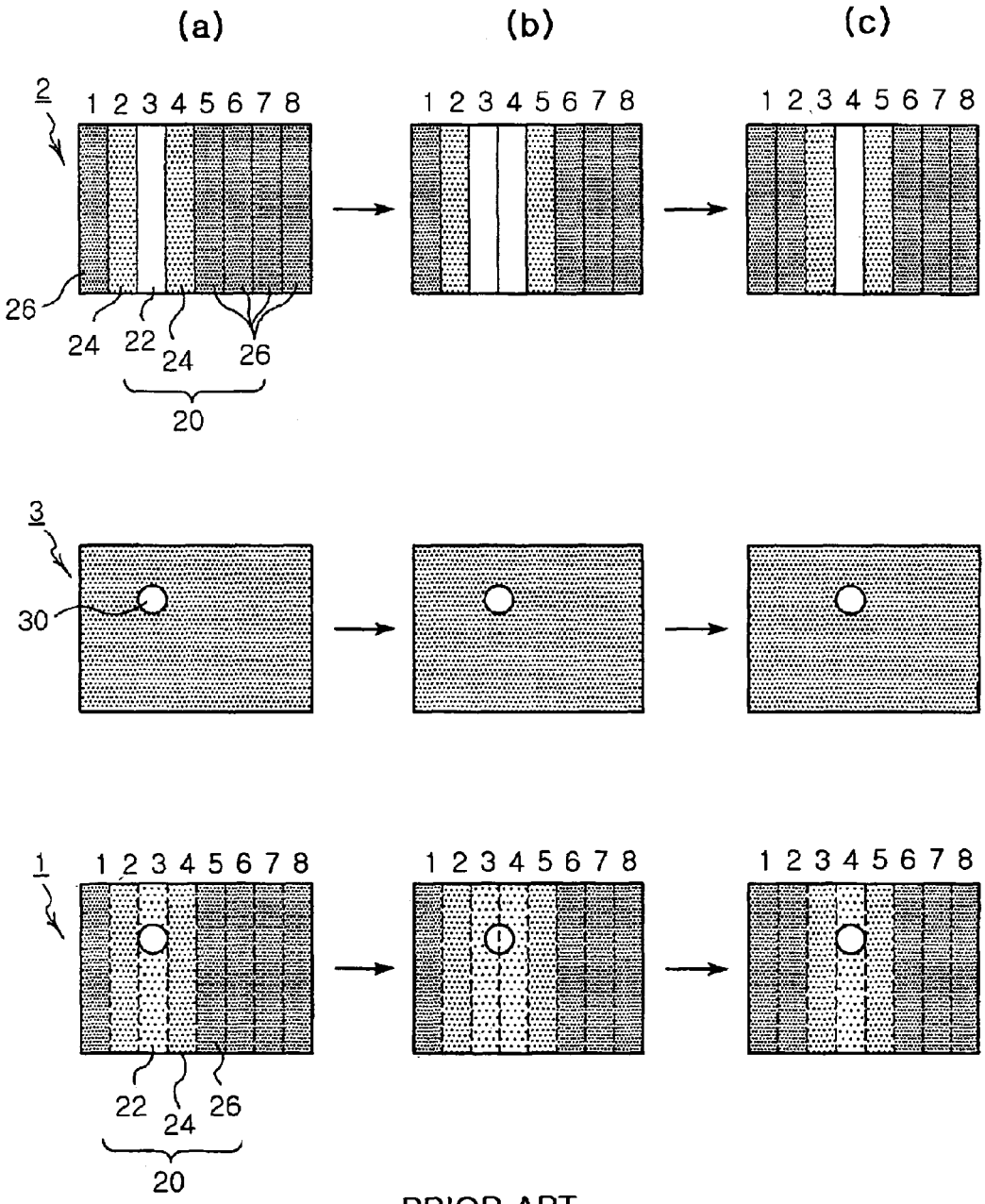
PRIOR ART FIG. 1
FIG. 1 sequentially illustrates operation of a conventional liquid crystal display (LCD) device.
Figure 2:
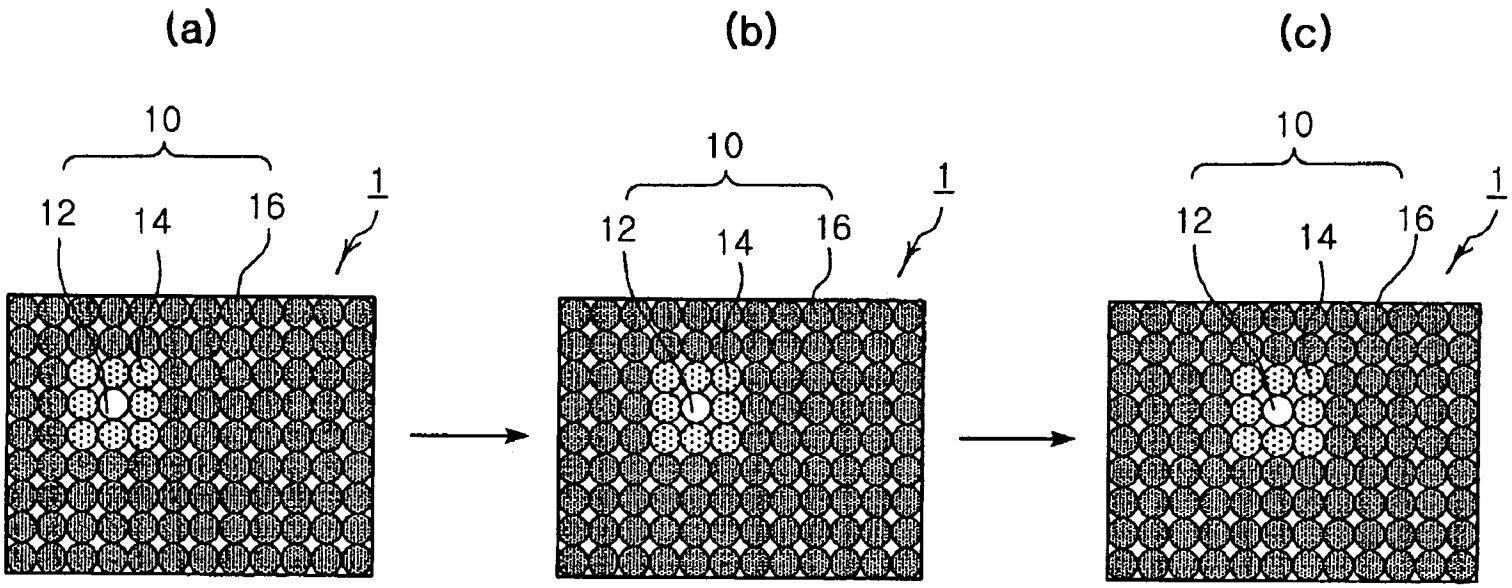
PRIOR ART FIG. 2
FIG. 2 sequentially illustrates operation of another conventional LCD device.

The backlight unit 110 may have the light sources arranged therein in parallel and, respectively, in a bar shape to simplify configuration and wiring thereof. That is, the backlight unit 110 may be configured identical to the conventional backlight unit 2 shown in FIG. 1. Alternatively, the backlight unit 110 may have the light sources arranged in close proximity with one another. Here, each of the light sources 110 may be shaped circular or square.

That is, the backlight unit 110 of the invention can be exemplified by any type of the conventional backlight unit 110. Also, the display panel 130 of the invention is identical in its structure and operation to the conventional display panel 130. Therefore operation and structure of the backlight unit 110 and the display panel 130 will be explained in no more detail.

The dimming structure 100 of the invention is characteristic and effective in that the contrast panel 120 is disposed between the backlight unit 110 and the display panel 130.

The contrast panel 120 transfers light emitted from the backlight unit 110 to only a portion of the display panel 130, more specifically, where the image 132 is outputted. This increases contrast differences between the image 132 and a peripheral portion thereof, thereby serving to enhance vividness of the image 132.

Also, in a case where a dim light is emitted around the image 132 to output the image 132 with visual depth, the backlight unit 110 emits brightest light from one of the light sources corresponding to the image 132, medium-bright light from adjacent ones of the light sources and do not emit light from the rest of the light sources. That is, when the image 132 is displayed in a portion of the display panel 130 as in step (a) of FIG. 3, the one of the light sources corresponding to the image 132, i.e., a third light source is a high-brightness light source 112. Left and right ones of the light sources about the high-brightness light source 112, i.e., second and fourth light sources are low-brightness light sources 114. The rest of the light sources excluding the high-brightness and low-brightness light sources 112 and 114 are off light sources 116.

Here, the contrast panel 120 transmits light from the light sources only through the portion corresponding to the image 132 so that light from the high-brightness light source 22 is not emitted through those portions of the panel 120 corresponding to upper and lower portions of the display panel 130 above and under the image 30. Therefore, a dim light is displayed only in a peripheral portion of the image 132 thereby to impart visual depth to the image 132. This serves to render the output image 132 more true-to life.

Here, according to the embodiment of the invention, to distinguish the image 132 from the light emitting window 122 more easily, the former 132 is indicated as a circle and the latter 122 is indicated as a square. However, preferably, the light emitting window 122 is shaped in accordance with a shape of the image 132.

In step (b) where the image 132 is shifted to the right by a half width of the light source from step (a), the third and forth light sources between which the image 132 is straddled are the high-brightness light source 112. Left and right ones of the light sources about the high-brightness light source 112, i.e., the second light source and a fifth light source are low-brightness light sources 114. The rest of the light sources excluding the high-brightness and low-brightness light sources 112 and 114 are off light sources 116 that do not emit light.

The contrast panel 120 shifts location of the light emitting window 122 according to location of the image 132, thereby ensuring a dim light to be displayed in the portion around the image 132 all the time. The contrast panel 120 configured to shift location of the light emitting window 122 is applicable to a black and white LCD in the same manner as a black and white LCD panel. But the contrast panel 120 can be variously modified in its configuration.

Also, in the dimming structure 100 of the invention, the size of the light emitting window 122 determines the lighting area of the high-brightness light source 112 that corresponds to the area of the image 132. Therefore, even when two of the high-brightness light sources 112 are actuated as in step (b), a dim-lit portion around the image 132 is produced in the same manner as in step (a). That is, the dim-lit portion around the image 132 is outputted constantly regardless of the number of the high-brightness light source 112. Accordingly, the dimming structure 100 of the invention allows the more true-to life image 132 to be displayed.

Moreover, the dimming structure 100 of the invention assures dimming effects on the image 132 despite use of the light source bigger than the image 132. This simplifies circuit wiring and internal configuration of the dimming structure 100, and reduces heat release rate, thereby not necessitating a separate device. Furthermore, this diminishes the number of the light sources per the same area, thereby consuming less power.

In step (c) where the image 132 is shifted to the right by a half width of the light source from step (b), only the fourth light source corresponding to the image 132 is the high-brightness light source 112. Left and right ones of the light sources about the high-brightness light source 112, i.e., the third and fifth light sources are low-brightness light sources 114. The rest of the light sources excluding the high-brightness and low-brightness light sources 112 and 114 are off light sources 116 that do not emit light. Here, the contrast panel 120 functions to shift the location of the light emitting window 122 in the same manner as step (a) to step (b) above. Thus, a detailed explanation of the operation of the contrast panel 120 will be omitted.

Figure 5:
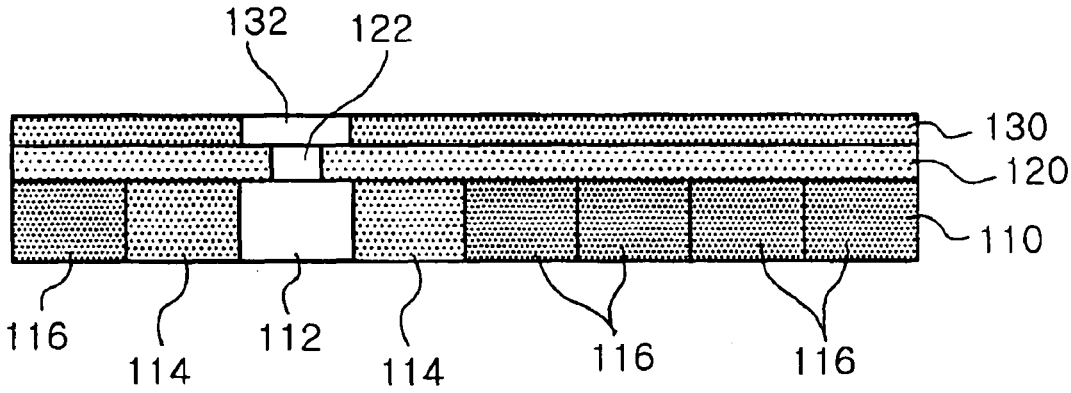
FIG. 5 is a cross-sectional view illustrating a dimming structure according to the invention.

FIG. 5 is a cross-sectional view illustrating a dimming structure according to the invention.

As shown in FIG. 5, the dimming structure 100 of the invention includes a contrast panel 120 disposed on a backlight unit 110, and a display panel 130 disposed on the contrast panel 120. Here, preferably, the light emitting window 122 is aligned with the image in a vertical center axis so that light emitted from the high-brightness light source 112 is more evenly transferred to the image 132.

According to the embodiment of the invention, the light emitting window 122 has a plane area smaller than that of the image 132. This allows the high-brightness light source 112 to irradiate light intensively onto a central portion of the image 132. Thus, the image 132 has an edge portion less bright than the central portion, giving visual depth to the image 132.

However, the plane area of the light emitting window 122 may be shaped variously without being limited to the embodiment shown in FIG. 5. For example, the light emitting window 122 has a horizontal shape identical to that of the image 132. Alternatively, the light emitting window 122 has a horizontal shape bigger than that of the image 132. In a case where the light emitting window 122 has a horizontal shape identical to that of the image 132, light from the high-brightness light source 112 emitted to the display panel 130 through the light emitting window 122 is uniformly irradiated onto every portion of the image 132, thereby outputting the vivid image 132. Meanwhile, in a case where the light emitting window 122 has a horizontal shape bigger than that of the image 132, light from the high-brightness light source 112 emitted to the display panel 130 is irradiated even onto the peripheral portion of the image 132, thus producing color bleeding effects. Preferably, the light emitting window 122 can be variously shaped and sized.

As described above, the dimming structure 100 of the invention adopts the conventional backlight unit 110 and the display panel 130, thus guaranteeing very effective applicability. Also, the light emitting device 122 can be altered in its shape and size to achieve various effects on the image 132.

As set forth above, according to exemplary embodiments of the invention, the dimming structure ensures uniform dimming effects on a portion around an image despite use of a light source bigger than the image to be outputted. This also simplifies internal configuration of the device, and reduces power consumption and heat release rate.

In addition, the dimming structure according to the invention can adopt a conventional LCD device, thus guaranteeing very effective applicability. Moreover, the dimming advice can produce various effects with a simplified structure.

While the present invention has been shown and described in connection with the preferred embodiments, it will be apparent to those skilled in the art that modifications and variations can be made without departing from the spirit and scope of the invention as defined by the appended claims.

What is claimed is:

1. A dimming structure for an image display device having a display panel to display an image, the dimming structure comprising:

a backlight unit having a plurality of light sources disposed therein the backlight unit disposed to light the display panel; and a contrast panel disposed between the backlight unit and the display panel, the contrast panel having a light emitting window formed in a portion thereof corresponding to the image of the display panel to transmit light emitted from the backlight unit therethrough, wherein the light emitting window has a size smaller than that of the image outputted from the display panel, and wherein the contrast panel shifts the location of the light emitting window according to the shifted location of the image of the display panel, and wherein the light emitting window has a horizontal cross-section, of which shape varies in accordance with a shape of the image.

2. The dimming structure according to claim 1, wherein the light emitting window is center-aligned with the image outputted from the display panel.

3. The dimming structure according to claim 1, wherein the backlight unit is configured such that one of the light sources corresponding to the image of the display panel emits brighter light, an adjacent one of the light sources emits less bright light and the rest of the light sources do not emit light.

4. The dimming structure according to claim 1, wherein the light sources are arranged in parallel and, respectively, in a bar shape.

5. The dimming structure according to claim 1, wherein the contrast panel is configured to transmit the light from the backlight unit through the light emitting window excluding the rest of the backlight unit.

* * * * *